United States Patent [19]

Bengtsson

[11] Patent Number: 4,548,432

[45] Date of Patent: Oct. 22, 1985

[54] LATCH ASSEMBLY

[76] Inventor: Sigurd W. Bengtsson, Bruksgatan 17, 41451 Göteborg, Sweden

[21] Appl. No.: 489,775

[22] Filed: Apr. 29, 1983

[30] Foreign Application Priority Data

Apr. 29, 1982 [SE] Sweden ..... 82-02701

[51] Int. Cl.[4] ..... E05C 9/02

[52] U.S. Cl. ..... 292/8

[58] Field of Search ..... 49/395; 292/5, 7, 8, 292/40, 36

[56] References Cited

U.S. PATENT DOCUMENTS 3,124,378 3/1964 Jackson ..... 292/5

FOREIGN PATENT DOCUMENTS 0021820 1/1981 European Pat. Off. .
1907061 9/1969 Fed. Rep. of Germany .
2266785 10/1975 France .
2463248 2/1981 France .
59133 7/1925 Sweden ..... 292/7
115899 2/1946 Sweden ..... 292/8

*Primary Examiner*—Richard E. Moore
*Attorney, Agent, or Firm*—Hill, Van Santen, Steadman & Simpson

[57] ABSTRACT

An operator for keeping doors, windows, shutters, or preferably entrance doors in a closed position has operating elements housed within a casing attached to a bar. A rod, for instance an espagnolette rod, is operatively connected to the operating elements and arranged for maneuvering at least one bolt.

The operating elements include means for maneuvering a further bolt. A handle is arranged for rotation in opposite direction from a neutral position. In one direction in the first bolt is manoeuvred, and in the other direction the further bolt is manoeuvred.

The operator has a spring device for returning the first bolt to a retracted position as soon as the handle returns from the position thereof corresponding to an extended bolt, unless the return movement of the bolt is positively prevented, for instance by friction engagement with the striker plate.

12 Claims, 8 Drawing Figures

LATCH ASSEMBLY

BACKGROUND OF THE INVENTION (a) Field of the Invention

The present invention relates to a latch assembly for keeping closures such as doors, windows, shutters, etc., preferably entrance doors, in a closed position.

(b) Prior Art

The problem behind the invention is to improve closing and locking latch assemblies, primarily for entrance doors, with due consideration of requirements for lock and false key security as well as energy saving, and not the least maneuvering.

A large number of closing and locking devices are known within the field, but as far as known they have all in common that they do not acceptably meet the requirements just mentioned or involve very complex and expensive constructions.

SUMMARY OF THE INVENTION

Therefore, the object of the invention is to obviate said lack and offer a more advantageous and optimum alternative.

In the broadest sense thereof, the invention provides a latch assembly operable by a handle, for instance a door handle, arranged for rotation in opposite directions, for keeping doors, windows, shutters, and primarily entrance doors, in a closed position, comprising operating elements housed within a casing attachable to a bar, for instance an espagnolette bar, and operatively connected to a rod, for instance an espagnolette rod, for maneuvering at least one bolt and comprising means for maneuvering a further bolt.

The means for maneuvering the first bolt includes a spring device for retracting said bolt to a retracted position in response to the return of the handle from the position thereof corresponding to an extended bolt, unless the return movement of the bolt is positively prevented, for instance by frictional engagement with a striker plate and/or due to latching of the rod.

In order to accomplish locking, preferably the first mentioned bolt as well as the further bolt are latchable by a latch acting on the rod.

In an especially preferred embodiment the rod is an espagnolette rod, preferably an undivided rod. Said at least one espagnolette bolt suitably is a hook bolt, and the further bolt is a bevelled bolt. The hook bolt(-s), due to the double function thereof of pressing the door against the sealing strip and effectively hooking together the door and door casement, provides a sufficient basis for the construction to meet the requirements of energy saving and lock/false key security.

The spring device that returns the hook bolt(-s) preferably comprises a tension spring fixed to the espagnolette lock casing and attached to the movable espagnolette rod.

In order to unload the lock mechanism of the device, if the door on which the assembly is mounted after some time should sink, the hook bolt(-s) preferably is (are) oriented such that the hook is turned upwards. Such orientation also prevents lifting off the door from the hinges thereof.

In order to adapt the assembly to an existing recess in the door edge and make the door pivotable, preferably the bevelled bolt is placed symmetrically in a standard door lock recess. Thus, a surface of this bolt facing away from its beveled end surface is disposed centrally in a casing of the latch assembly.

In a preferred embodiment, the bevelled bolt is placed on the center line of the recess of the rotational center of an operating member maneuvering the espagnolette rod and the bevelled bolt and the rotational center of a further operating member maneuvering the latch, respectively. Such placement makes the arrangement adapted to existing holes for a lock and door handle, respectively.

Suitably, the arrangement is such that the first mentioned operating member is spring loaded to a rest position and the bevelled bolt is spring loaded to an extended position, and such that the bevelled bolt is lockable in said position by engagement of a projection of the espagnolette rod with a recess in the bolt and latching of the espagnolette rod with the latch.

The espangolette rod serves the dual function, preferable from a security point of view, of providing latching of the bevelled bolt as well as the hook bolt(-s).

In an alternative embodiment the spring device for returning the hook bolt comprises a compression spring arranged at the end of the espagnolette rod.

In a further alternative embodiment the first mentioned bolt and/or the further bolt are latchable by a latch acting on an interconnecting element of a divided espagnolette rod.

The interconnecting element may be provided with an abutment/recess for latching merely the first mentioned bolt.

The interconnecting element may be provided also with an abutment/recess for latching of the first mentioned as well as the further bolt.

ON THE DRAWINGS

FIG. 1 in a partial view shows the basic structure of the assembly in a rest position;

FIG. 2 in a simplified partial view shows the assembly in a position where a handle has been rotated upwards;

AS SHOWN ON THE DRAWINGS

Figure 1:
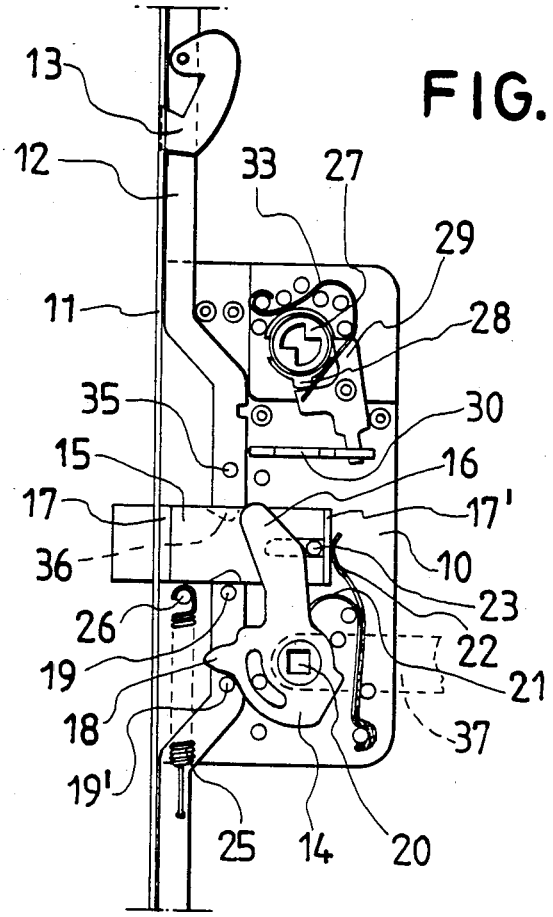

The assembly in FIG. 1 basically comprises a lock casing 10 attached to an espagnolette edge bar 11. The bar 11 and the lock casing 10 are arranged for mounting in a recess in a door edge. There is also an espagnolette rod 12 displaceable along the door edge and acting as a latching rod for maneuvering at least one bolt 13 (only one has been shown). There is a handle operating member 14 in the lock casing 10 acting on a bevelled bolt 15 by an arm 16, that cooperates a pair of abutments 17, 17' on the bevelled bolt 15, and acting on the latching rod 12 by an arm 18 cooperating a pair of studs 19, 19'. There is a non-circular hole 20 in the operating member 14 arranged for cooperation with a handle 37 or similar actuator (shown in broken lines in FIG. 1). A spring 21 has been attached for returning the handle 37 to the horizontal position via the operating member 14 after the handle 37 has been depressed for opening or closing the door. A spring 22 acts to maintain the bevelled bolt 15 in position after it has been retracted. The movement of the bevelled bolt 15 and thereby also the operating member 14 is limited in both directions by a stud 23 attached to the lock casing 10 and cooperating with an elongated groove in the bevelled bolt. A tension spring 25, at one end thereof fixed to a stud 26 in the lock casing and at the other end attached to the moveable espagnolette rod 12, maintains the latching rod 12 in such a position that the espagnolette bolts 13 are pulled into the bar 11 due to the action from the spring 25 when the handle 37 is in the rest position, unless latching/locking has been carried out or the bolts are maintained in an extended position due to friction against the striker plates. Thus, in the rest position of the assembly in FIG. 1 the espagnolette bolts 13 are retracted, but the bevelled bolt 15 is extended.

In order to make the assembly lockable, for instance by a cylinder lock, there is a lock operating member 27 having a dog 28, at the upper part of the lock casing 10. The dog 28 acts on a latch 30 via a three armed lever 29. The latch 30 has two pair of projections 31, 31' (FIG. 2) for guiding the latch 30 in grooves in two halves of the casing 10. The latch is arranged for cooperation with a recess 32 in the espagnolette rod 12. A spring 33 is arranged for indicating the end positions of the operating member 27 in cooperation with the dog 28.

Figure 2:
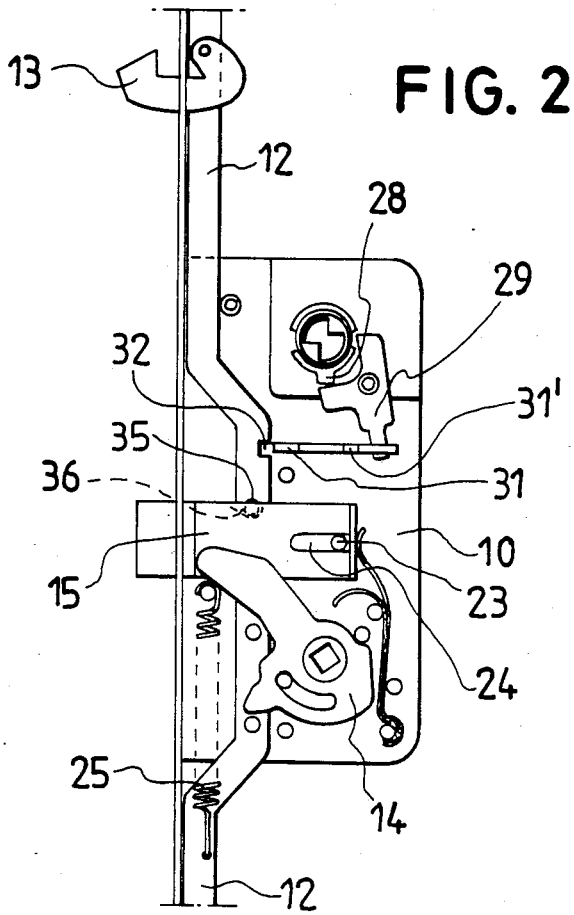

In FIG. 2 the handle has been rotated upwards and the bevelled bolt 15 as well as the espagnolette bolts 13 are extended and engage a respective one of the striker plates of the door casement. In such a position, locking by a key is carried out, meaning that the lock operating member 27 in the previously mentioned manner by means of the dog 28 and via the lever 29 brings the latch 30 into engagement with the recess 32 in the latching rod 12. In such a position also the bevelled bolt is latched in that a stud 35 on the latching rod 12 engages a recess 36 in the bevelled bolt 15.

Figure 3:
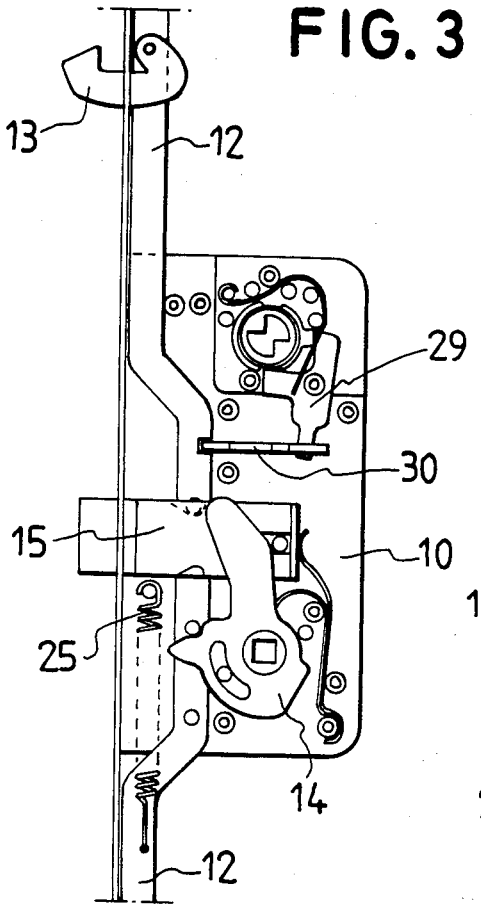
FIG. 3 shows the assembly as in FIG. 2 but with a latching rod thereof latched and with the handle in a rest position.

In FIG. 3 it is shown how the latch 30 has engaged the latching rod 12 and the handle has been returned to the neutral position or the rest position, basically under the force of gravity.

Figure 4:
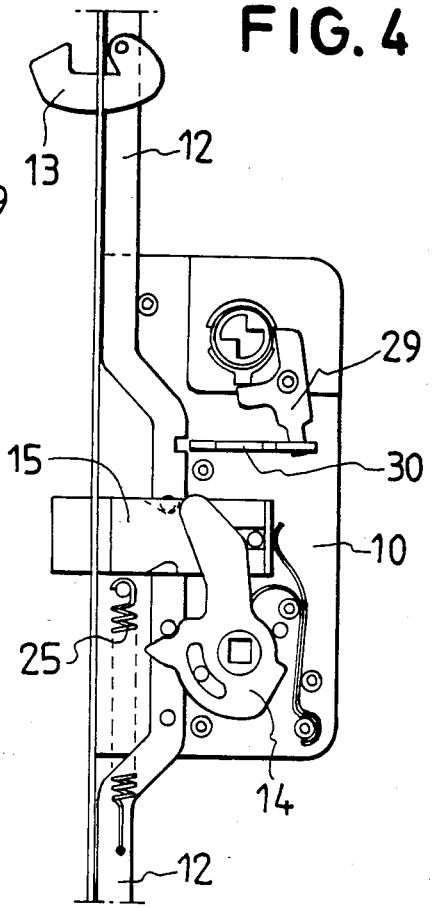
FIG. 4 shows the assembly in an unlatched condition with espagnolette bolts as well as bevelled bolts in extended positions, the espagnolette bolts for instance being maintained in such position due to friction against the striker plate of the door casement.

In FIG. 4 it is shown how the assembly has been unlatched and the latch 30 has been disengaged from the latching rod 12.

Figure 5:
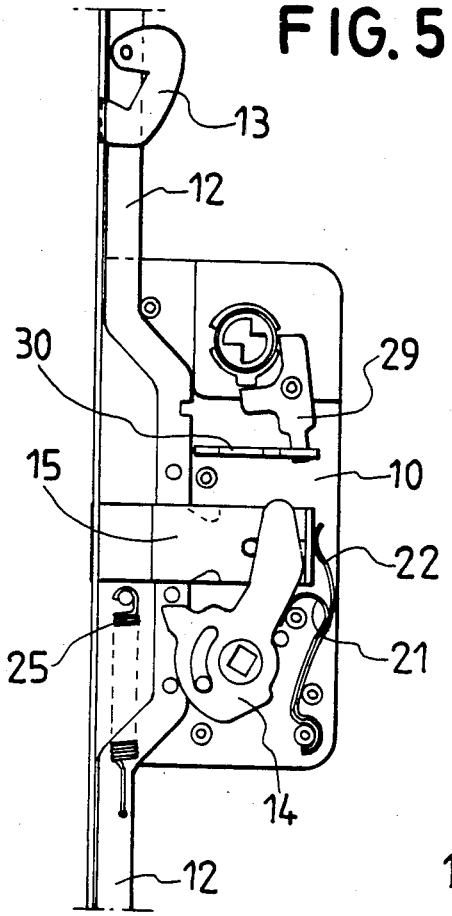
FIG. 5 shows the assembly in a condition where the handle has been rotated downwards, has returned the espagnolette bolt to a retracted position, and has moved the bevelled bolt backwards.

In FIG. 5 it is shown that the handle has been depressed and that all bolts have been retracted under the action from the espagnolette rod 12 and operating member 14, respectively. As soon as the handle is released it returns to the horizontal position due to the action of the spring 21 simultaneously as the spring 22 extends the bevelled bolt 15. At this time all element of the arrangement are in the positions shown in FIG. 1.

Figure 8:
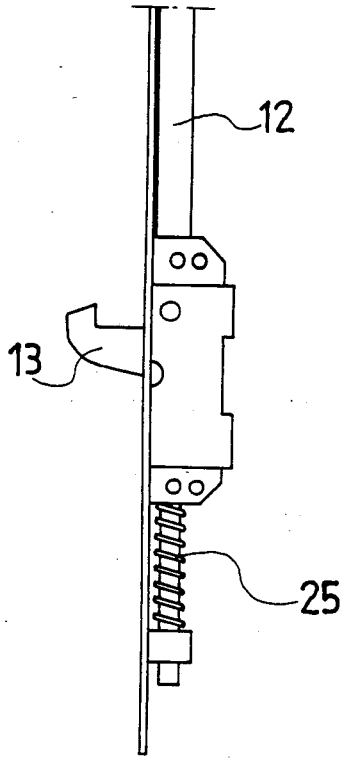
FIG. 8 shows an alternative placement of a hook bolt return spring.

In the modification according to FIG. 8, a compression spring 25A has been substituted for the tension spring 25 arranged at one end of the espagnolette rod 12 for retracting the hook bolt(-s) 13 into the edge bar 11, provided such movement is not hindered by sufficiently large friction (against striker plates) or by latchment of the rod 12.

Figure 6:
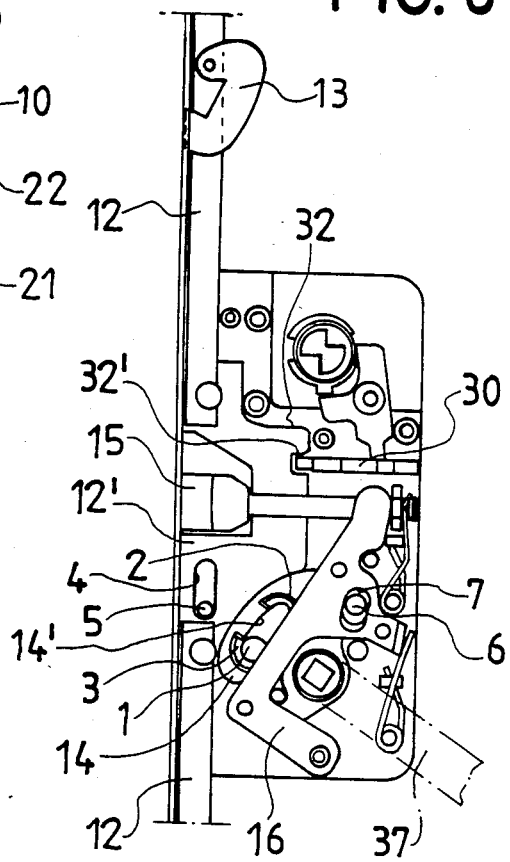
FIG. 6 shows an assembly comprising a divided rod with the hook bolt in a latched, withdrawn position.
Figure 7:
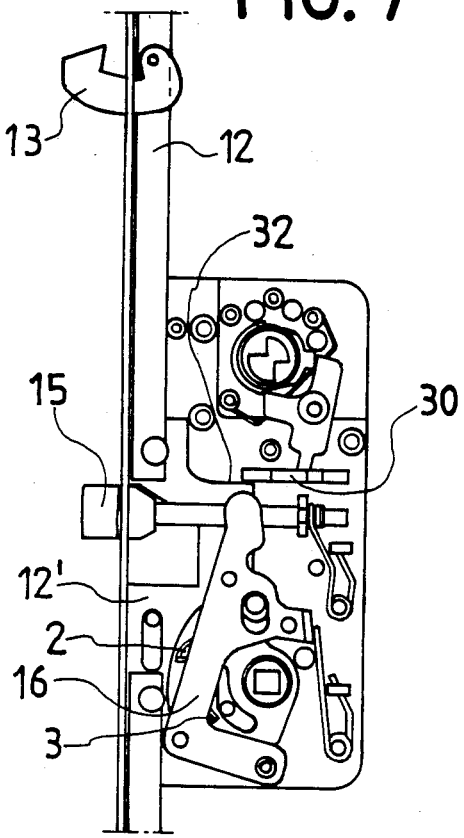
FIG. 7 shows an assembly as in FIG. 6 with the hook bolt as well as the bevelled bolt in a latched, extended position.

The assembly according to FIGS. 6 and 7 comprises a divided espagnolette rod and a connection element 12' interconnecting the two rod halves. The operating member 14 is provided with a groove 14' arranged for cooperation with a stud 1 on the connecting element 12'. A pair of end segments 2 and 3 control the rotational movement of the operating member in relation to the vertical position of the connecting element 12'. The movement of the lever or arm 16 of the operating member is transferred by a stud 6 on the operating member and guided in a groove 7 in the lever.

In FIG. 6 the connecting element is in the upper position thereof defined by a groove 4 and a stud 5.

In said position the hook bolt 13 is latched by the locking latch 30 gripping in the recess 32' in the connecting element. In spite of said latching the end segments 2, 3 allow rotation of the operating member 14 and retraction of the bevelled bolt 15, as appears from FIG. 6. Such rotation is allowed due to the placement of the groove 14' in the operating member.

However, when the connecting element 12' assumes the lower position thereof, as in FIG. 7, the relative positioning of the stud 1 and the groove 14'/with its end segments 2, 3, respectively, prevents pushing down of the handle and retraction of the bolts, provided the locking latch 30 grips a locking surface 32'' of the connecting element 12'. Thus, in FIG. 7 the hook bolts as well as the bevelled bolt 15 are latched.

I claim:

1. A latch assembly for being installed on the edge of a closure for holding the closure in a closed position, such closure having a recess in such edge, said assembly comprising:

(a) an espagnolette edge bar adapted to be secured to the closure's edge;

(b) a casing secured to said edge bar for being received in the recess of the closure;

(c) at least one bolt disposed remotely from said casing, and supported by said edge bar for movement to a locking position and to a retracted position;

(d) an espagnolette rod operatively connected to said one bolt for maneuvering it;

(e) a further bolt slidably supported in said casing;

(f) a handle-controlled operating member in said casing for reciprocating said rod and said further bolt; and (g) a spring device acting on said rod in a direction to retract said one bolt in response to the return of the handle from the position thereof effecting the extension of said one bolt.

2. An assembly according to claim 1 including means operatively interconnecting said rod and said further bolts, and a latch in said casing for acting on said rod to lock both of said bolts in their extended positions.

3. An assembly according to claim 2 including a second operating member for maneuvering said latch, said operating members having rotational axes, said further bolt being doubled and being located in said casing centrally between said rotational axes.

4. An assembly according to claim 2 including a second operating member for maneuvering said latch, said first-named operating member being spring-loaded to a rest position and said further bolt being spring-loaded to an extended position, and said interconnecting means including a recess in said further bolt receptive of a projection on said rod for locking said further bolt in said extended position in response to latching of said rod by said latch.

5. An assembly according to claim 2, said one bolt being a pivotable hook bolt, and said further bolt being a bevelled bolt.

6. An assembly according to claim 1, said spring device for retracting said one bolt being a tension spring acting between said casing and said rod.

7. An assembly according to claim 5, said hook bolt having its free end directed upwardly in its said locking position.

8. An assembly according to claim 5, said bevelled bolt being disposed symmetrically in said casing, whereby it will be symmetrically disposed in the closure recess.

9. An assembly according to claim 1, said spring device for retracting said one bolt being a compression spring acting at the end of said rod.

10. An assembly according to claim 2, said rod comprising two portions joined together by an interconnecting element, said latch being engageable with said interconnecting element.

11. An assembly according to claim 10, said interconnecting element having a recess receptive of said latch in the raised position of said rod for latching said one bolt in a retracted position.

12. An operator according to claim 11, said interconnecting element having a shoulder abuttable by said latch in the lowered position of said rod for latching both said bolts in their extended positions.

* * * * *